US005293708A

United States Patent [19]

Strayer et al.

[11] Patent Number: 5,293,708

[45] Date of Patent: Mar. 15, 1994

[54] FRAME/HANDGRIP ASSEMBLY FOR AUTOLOADING HANDGUN

[76] Inventors: Sandy L. Strayer, 305 Hickok, Round Rock, Tex. 78681; Virgil P. Tripp, 8907 Sparkling Creek Cir., Austin, Tex. 78729

[21] Appl. No.: 910,636

[22] Filed: Jul. 8, 1992

[51] Int. Cl.[5] ..... F41A 11/00; F41A 21/00

[52] U.S. Cl. ..... 42/75.03; 42/7; 42/71.02

[58] Field of Search ..... 42/7, 71.02, 75.03, 42/75.01

[56] References Cited

U.S. PATENT DOCUMENTS

| | | | |
|---|---|---|---|
| 965,386 | 7/1910 | Hanson | 42/7 |
| 1,024,932 | 4/1912 | Vander Haeghen | 42/7 |
| 1,407,959 | 2/1922 | Stokke | 42/7 |
| 2,460,598 | 2/1949 | Rosvall | 42/7 |
| 2,828,568 | 4/1958 | Sakewitz | 42/7 |
| 2,832,266 | 4/1958 | Sunderland | 42/7 |
| 3,167,876 | 2/1965 | Milroy | 42/7 |
| 3,683,535 | 8/1972 | Lewis | 42/71.02 |
| 3,758,978 | 11/1973 | Theodore | 42/71.02 |
| 4,242,824 | 1/1981 | Pachmayr et al. | 42/71.02 |
| 4,539,889 | 9/1985 | Glock | 89/147 |
| 4,638,582 | 1/1987 | Farrar | 42/71.01 |
| 4,811,510 | 3/1989 | Chesnut | 42/7 |
| 4,825,744 | 5/1989 | Glock | 42/145 |
| 4,833,812 | 5/1989 | Farrar | 42/71.02 |
| 4,862,618 | 9/1989 | Szabo | 42/7 |
| 4,878,304 | 11/1989 | Cupp | 42/71.02 |
| 4,888,899 | 12/1989 | Chesnut et al. | 42/50 |
| 4,893,546 | 1/1990 | Glock | 89/145 |
| 4,936,036 | 6/1990 | Sniezak et al. | 42/71.02 |
| 5,113,603 | 5/1992 | Buegel | 42/7 |

FOREIGN PATENT DOCUMENTS

| | | | |
|---|---|---|---|
| 1805399 | 8/1970 | Fed. Rep. of Germany | 42/71.02 |
| 2192048A | 12/1987 | United Kingdom | 42/7 |

*Primary Examiner*—David H. Brown
*Attorney, Agent, or Firm*—James L. Jackson

[57] ABSTRACT

A frame/handgrip assembly is provided for autoloading handguns of the Model 1911 A1 type which incorporates a gripless preferably metal frame structure having guide rails for receiving a conventional slide and having a configuration for receiving other standard 1911 A1 components. The frame structure defines opposed handgrip seats including one or more keyways. An integral handgrip structure is provided having spaced connector elements having one or more internal keys for establishing mating, interlocked structural relationship with the handgrip seats. The handgrip structure incorporates an integral trigger guard and both the trigger guard and the connecting elements of the handgrip are physically interlocked with the frame structure by means of screws, pins, etc. The frame and handgrip structures may cooperatively define a wide internal cartridge magazine receptacle for receiving a wide, staggered row, enhanced volume cartridge magazine. The handgrip structure is a structural element of the frame/handgrip assembly and defines outer grip surfaces presenting surface preparation for efficient gripping and defining a maximum handgrip thickness being substantially the same as the handgrip thickness of a standard Model 1911 A1 handgun. The frame and handgrip sections of the assembly each provide for wholly contained location of structural and operational components while establishing a functionally interdependent relationship between such components.

42 Claims, 5 Drawing Sheets

FIG. 1
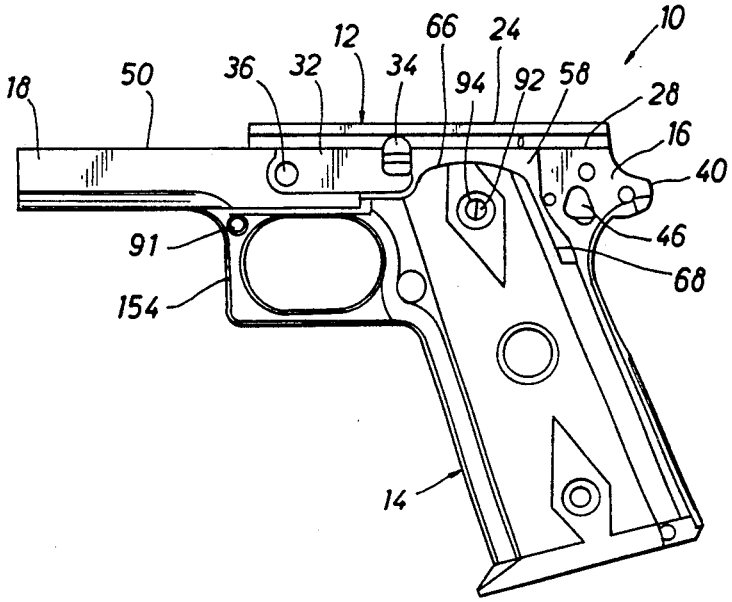
FIG. 2
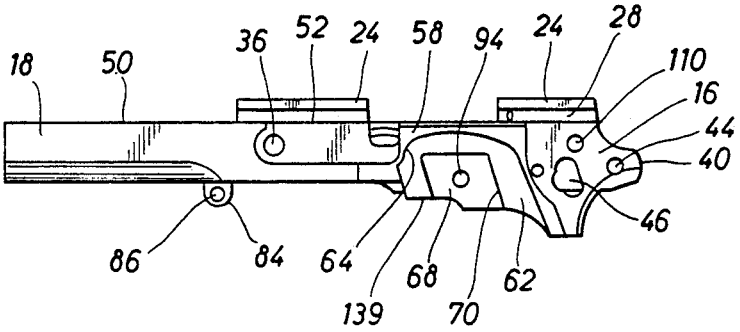
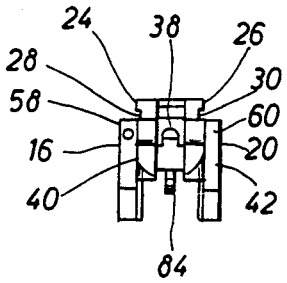
FIG. 3
FIG. 4
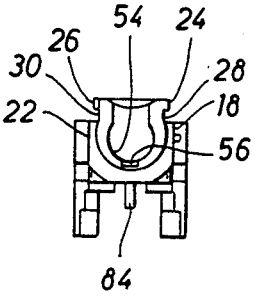
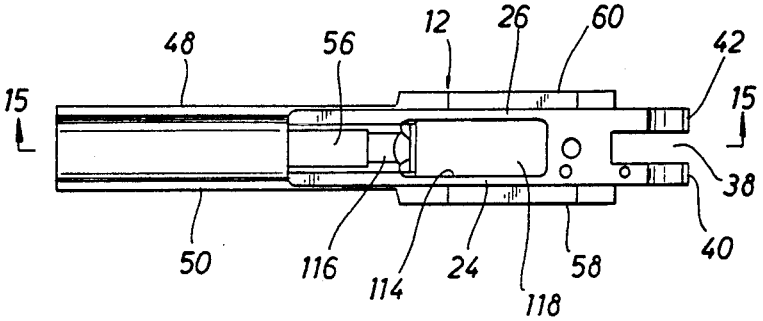
FIG. 5

FIG. 6
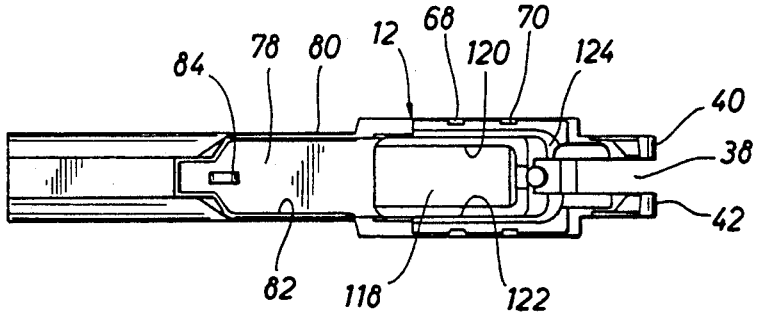
FIG. 7
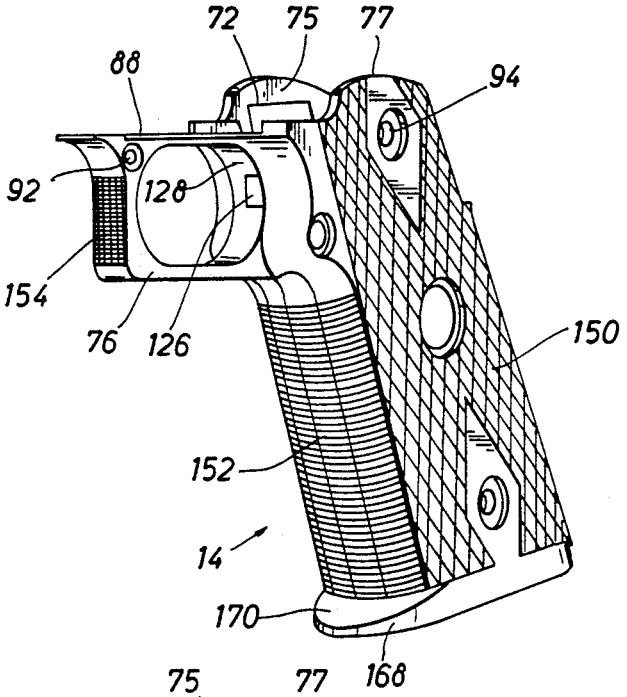
FIG. 8
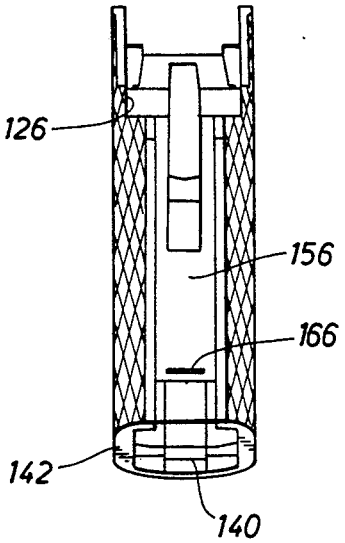
FIG. 9
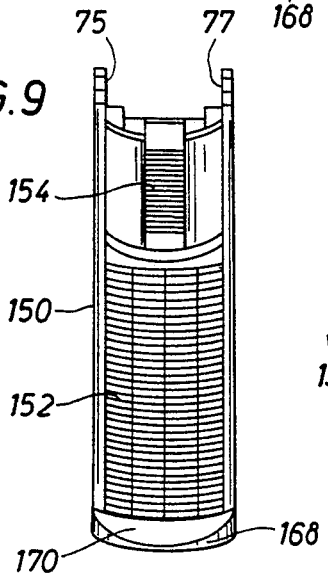
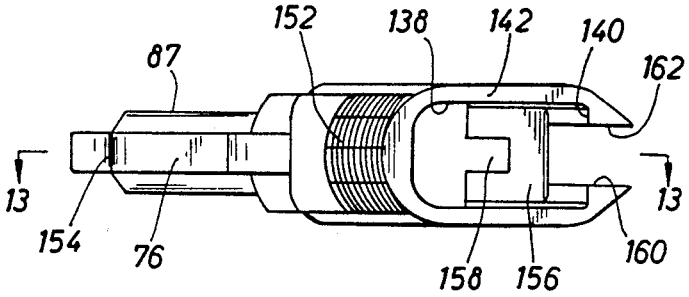
FIG. 10

FIG. 11
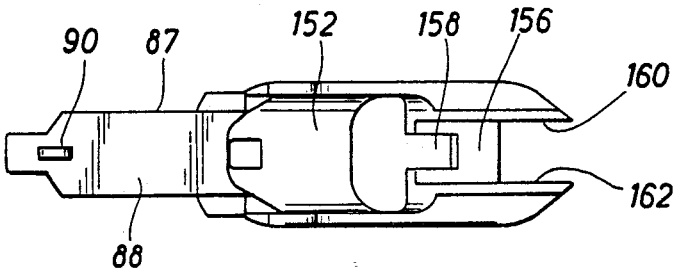
FIG. 12
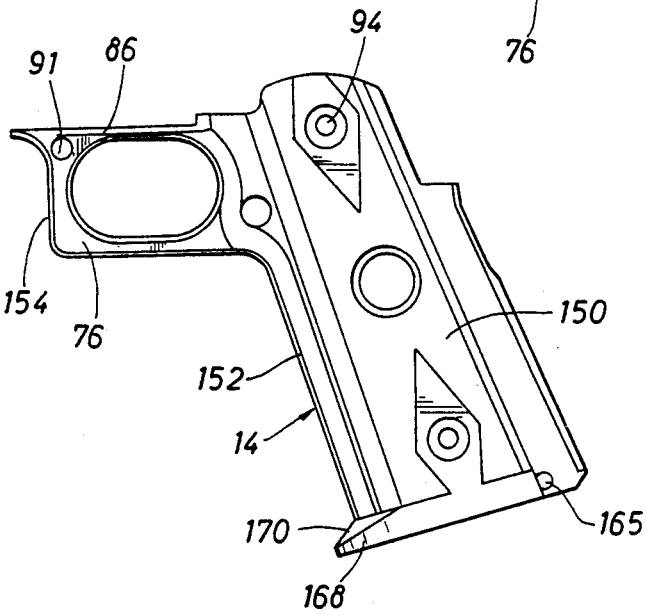
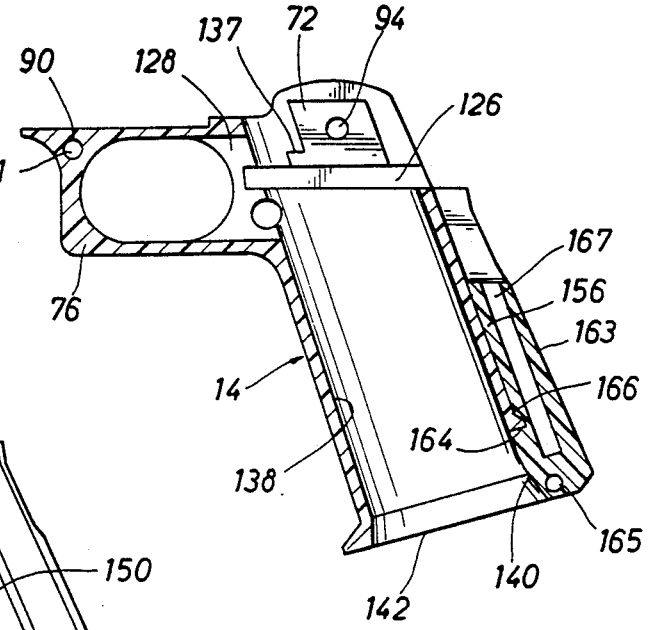
FIG. 13
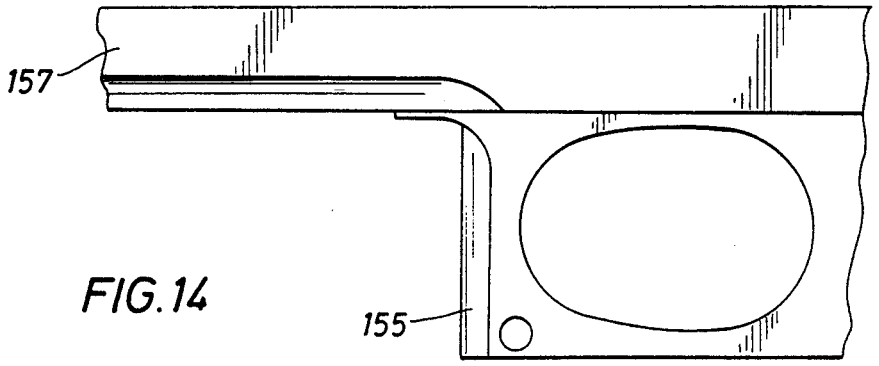
FIG. 14

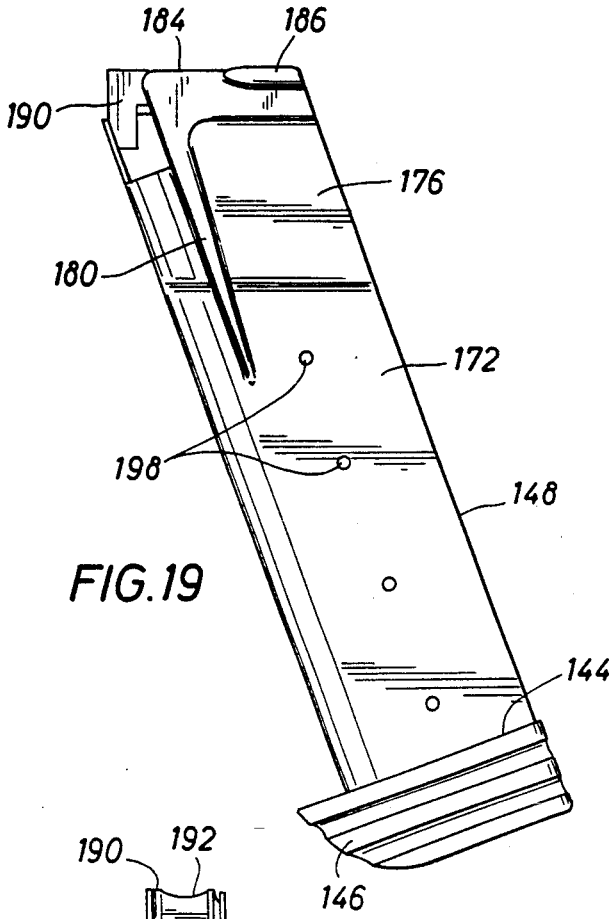
FIG. 19
FIG. 20
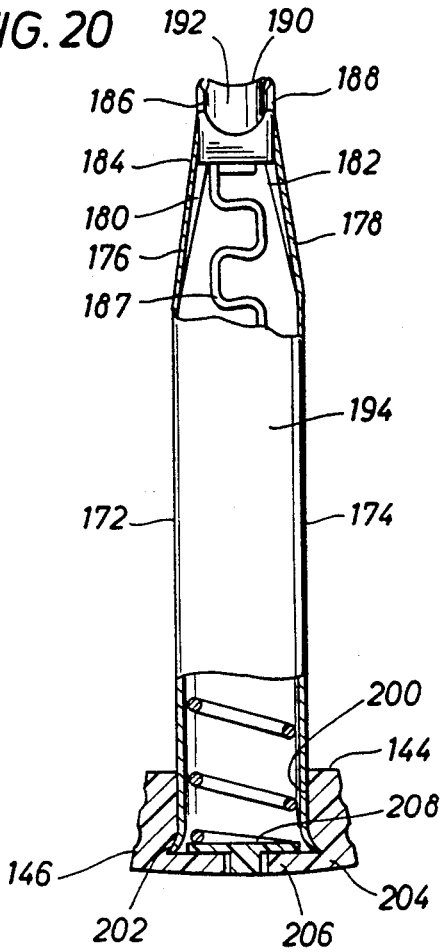
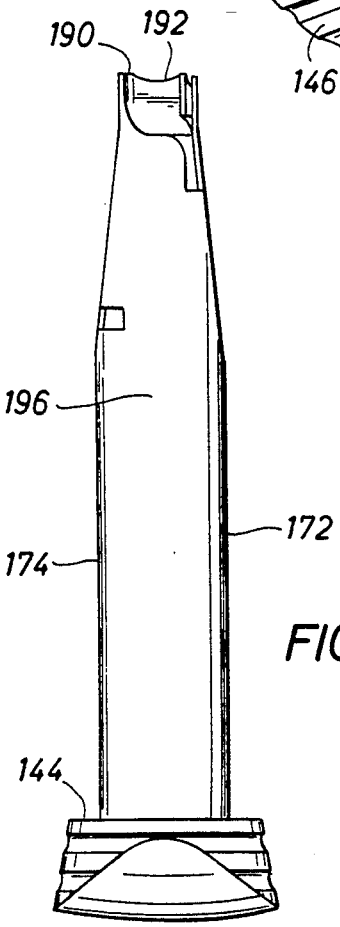
FIG. 21
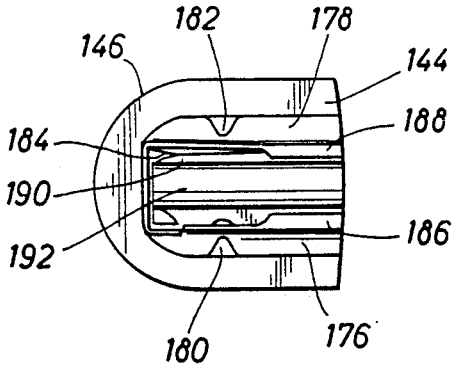
FIG. 22
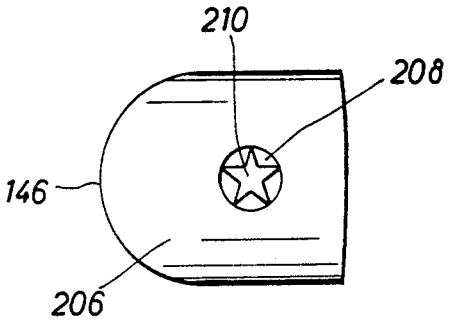
FIG. 23

FRAME/HANDGRIP ASSEMBLY FOR AUTOLOADING HANDGUN

FIELD OF THE INVENTION

This invention relates generally to autoloading handguns and more specifically to a handgun frame/handgrip assembly incorporating structural and operational mechanisms that are interdependent upon the frame and handgrip from the standpoint of location and function. This invention also concerns a frame/handgrip assembly which facilitates enhanced cartridge capacity and yet having a handgrip of substantially the same external configuration and manual "feel" as compared to a conventional Government Model 1911 A1 handgun.

BACKGROUND OF THE INVENTION

At the present time, all autoloading handguns, whether composed of cast or machined metal or polymer, have an integral frame structure incorporating a receiver for the barrel, hammer and reciprocating slide mechanisms and having a handgrip structure that is integral with the frame. There is not presently known in the handgun industry a frame/handgrip assembly for autoloading handguns wherein both the frame and the handgrip provide for location of structural and operational components and wherein these structural and operational components, located wholly within the frame or handgrip or co-located by assembled frame and handgrip structures, are functionally interdependent.

In the sport of competitive target shooting with handguns, rapid-fire handgun target shooting activities have become a significantly important aspect of handgun target shooting events. Of late, considerable interest has developed toward the provision of handguns having increased round capacity, as compared to the 1911 A1 handgun which, in 0.45 caliber ACP, has a magazine capacity of seven rounds. A number of autoloading handgun designs are presently being marketed which employ staggered-row cartridge enhanced capacity magazines and wherein the frame of the handgun construction has a handgrip and magazine receptacle of sufficiently large internal dimension that larger, staggered row magazines can be received therein.

One of the principal problems with these types of increased capacity handguns is that the increased width internal magazine receptacles required by wide staggered row cartridge magazine, together with the wood or polymer grip plates with which they are typically provided, causes the handgrips to be quite large and bulky. Large dimensioned handgun grips are considered generally unacceptable to most target shooting enthusiasts, especially female target shooting enthusiasts whose hands are typically anatomically small. Handgrips for autoloading handguns of the standard Government Model autoloading handgun are of a dimension that provide most target shooters with a highly desirable manual "feel" thereby causing these types of handguns to be preferred for the purpose of target shooting as compared with autoloading handguns of increased round capacity having large, bulky handgrips.

In the field of law enforcement, autoloading handguns are often utilized. In this case autoloading handguns with increased round capacity are highly desirable. Handguns having large handgrips to permit increased round capacity are not well received in the field of law enforcement because of the wide and bulky nature thereof. Consequently, many law enforcement personnel, to achieve higher round capacity, have favored autoloading handguns of smaller caliber than the typical 0.45 caliber ACP simply because the smaller caliber permits a larger number of cartridges to be contained within the storage magazine of the handgun. Obviously, this is considered a trade-off because smaller caliber cartridges such as 9 mm cartridges frequently have significantly less knock-down power as compared to 0.45 caliber ACP cartridges.

It is considered desirable, therefore, to provide a autoloading handgun that may be manufactured to handle 0.45 caliber ACP cartridges and yet will have an increased round capacity to provide greater fire-power than is ordinarily obtainable with the standard Model 1911 A1 handgun. It is also desirable to provide a autoloading handgun of increased round capacity which incorporates a handgrip having substantially the size and feel of the standard Model 1911 A1 handgun. Heretofore, these desirable features have not been considered attainable.

Increased capacity handguns, because of the larger, bulkier frames thereof, are generally considerably heavier in weight as compared to the 1911 A1 handgun. This is because significantly more metal is required in the handgrip and magazine receptacle portions of the frame. In some cases, manufacturers have chosen to provide a handgun frame which is manufactured of light-weight aluminum or aluminum alloy material, thus minimizing the weight of the enlarged metal frame. This is also considered an undesirable "trade-off" because aluminum and aluminum alloys are of considerably less structural integrity as compared to a metal such as steel and when constructed with thin metal sections to minimize "bulk" they tend to develop stress fractures during use. It is desirable, therefore, to provide a staggered row magazine, increased round capacity, autoloading handgun of large caliber such as 0.45 caliber ACP and which has approximately the same handgrip size and weight as compared to a standard Government Model 1911 A1 handgun of the same large caliber. Heretofore this feature has also been considered unattainable.

During the development of the autoloading handgun frame/handgrip assembly of the present invention a number of design considerations were considered paramount. It was decided that the resulting handgun, to be acceptable to most target shooters, should have the capability of utilizing many parts such as the slide, barrel, recoil assembly, hammer assembly, etc. of the 1911 A1 handgun because it is well known to be the most dependable and most widely used handgun for target shooting and for law enforcement. Another major design parameter was to provide an increased round capacity autoloading handgun having an increased width magazine chamber or receptacle while maintaining essentially the same external handgrip width as compared with the standard 1911 A1 handgun. An even further major design consideration was to provide an increased round capacity autoloading handgun construction having an overall weight closely approximating the overall weight of a standard 1911 A1 handgun and to do so without resorting to the use of lightweight metal such as aluminum to form the frame structure. For a lighter than usual model, it was also considered appropriate to utilize lightweight metals such as aluminum, titanium, etc. for the frame and to provide a frame design utilizing such lightweight metals without any sacrifice from the standpoint of adequate structural integrity.

SUMMARY OF THE INVENTION

It is a principal feature of the present invention to provide a novel frame/handgrip construction for autoloading handguns wherein structural and operational components are located within one of the two major structural components, i.e., the frame or the handgrip and are functionally interdependent with operational components that are located in or supported by the opposite major structural component.

It is another feature of the present invention to provide a novel frame/handgrip assembly for increased round capacity, autoloading handguns wherein the handgrip portion thereof is of substantially the same external thickness dimension as compared with the Government Model 1911 A1 handgun and yet has an internal magazine receptacle of greater than standard width.

It is another feature of this invention to provide a novel frame/grip assembly for autoloading handguns which accommodate large, staggered row cartridge magazines to provide for enhanced round capacity.

It is also a feature of this invention to provide a novel frame/grip assembly for autoloading handguns which is of light weight construction without any sacrifice from the standpoint of structural integrity so that the resulting autoloading handgun, including the enhanced number of rounds thereof, approximate the weight of a loaded conventional Government Model 1911 A1 handgun.

It is a further feature of this invention to provide a novel frame/grip assembly for autoloading handguns wherein the handgrip portion thereof may define a large dimensioned internal cartridge magazine chamber for containing enhanced volume staggered row cartridge magazines and yet provide an external handgrip dimension being substantially the same as the handgrip dimension of a standard Government Model 1911 A1 handgun.

It is an even further feature of this invention to provide a novel frame/handgrip assembly for autoloading handguns which includes a gripless frame composed of metal or any other suitable material to which is releasably assembled a handgrip structure composed of polymer material or any one of a number of suitable metals including but not limited to steel, aluminum, titanium, sintered metals and metal composites, etc.

It is another feature of this invention to provide a novel frame/handgrip assembly for autoloading handguns incorporating a handgrip structure of polymer or metal composition and which may be machined, cast, sintered, additive machined or formed by any other suitable process.

It is among the several features of this invention to provide a novel frame/handgrip assembly for autoloading handguns wherein the frame and handgrip may be assembled by a sliding fit and are provided with a key-keyway structural interlocking configuration to provide for substantially rigid assembly between the frame and the handgrip.

It is another feature of this invention to provide a novel frame/handgrip assembly for autoloading handguns incorporating a frame to which is releasably assembled a polymer handgrip that is substantially rigid from the standpoint of handgripping and feel and being slightly yieldable to provide "controlled flexibility" to cushion the sharp force ordinarily imparted to the user's hand during firing to thus provide the frame/handgrip assembly with a "soft shooting feel" during handgun shooting activities.

It is another feature of this invention to provide a novel separable frame/handgrip assembly for autoloading handguns which provides for location of the mainspring assembly wholly within the handgrip construction and yet functionally interdependent with the hammer assembly which is located wholly within the gripless frame construction.

It is an even further feature of this invention to provide a novel frame/handgrip assembly for autoloading handguns incorporating a rigid frame to which is releasably assembled a handgrip section incorporating an integral trigger guard and wherein both the handgrip and trigger guard sections are mechanically interlocked with the frame structure.

It is another important feature of this invention to provide a novel frame/handgrip assembly for autoloading handguns wherein the frame defines guide rails for movably receiving a reciprocating slide and wherein the guide rails are either interrupted or uninterrupted, depending upon the character of manufacture that is desired.

It is also an important feature of this invention to provide an enhanced round capacity staggered row cartridge magazine which is properly positioned within the magazine receptacle of the handgun by a stop shoulder at the lower portion of the magazine which stops against the lower end of the handgrip structure.

It is another feature of this invention to provide a novel enhanced round capacity staggered row cartridge magazine having a base structure including a frangible blow-out section for safely releasing any sudden build-up of gas pressure within the magazine.

It is also an important feature of this invention to provide a cartridge magazine having a unique relationship between the helix direction of the compression spring and the configuration of the follower.

Briefly, the various features of the present invention are realized through the provision of a frame/handgrip assembly for autoloading handguns which incorporates a gripless frame structure of a design having efficient structural integrity whether composed of steel or whether composed of other metals or other suitable materials. Though the term "metal frame" is frequently employed herein, it is not intended to limit the range of metal and non-metal materials that may be employed in the manufacture of the frame structure. The frame structure is of elongate construction and defines guide rails for receiving the reciprocating slide portion of the handgun. The frame/handgrip assembly of this invention is capable of receiving conventional 1911 A1 components such as the slide assembly, trigger assembly, hammer assembly, slide lock, thumb safety, rear, hammer, spring, leaf spring, magazine catch, etc. These elements, referred to herein as structural and "operational components" are incorporated herein by reference to the extent needed for a complete description of a functional handgun assembly. The standard slide of a Government Model 1911 A1 handgun is receivable in properly interfitting relation with the guide rails of the frame structure. In fact, many operational components of the standard 1911 A1 handgun are capable of being received in interfitting relation with the frame/handgrip assembly of this invention. To suit the needs of manufacturer or user, the guide rails of the frame may be uninterrupted as is the case with the standard 1911 A1 handgun, but, if desired, the guide rails may be interrupted to form pairs of front and rear guide rail segments.

The metal frame structure includes a forwardly extending, substantially U-shaped guide trough or "dust cover" for receiving the recoil spring assembly of the handgun, the integral side structures of the U-shaped guide trough are preferably of greater thickness as compared with the 1911 A1 handgun so as to provide for support of various sighting devices such as optical sighting devices The metal frame further defines a cartridge magazine receptacle of sufficient dimension for receiving the upper portion of an enhanced volume, staggered row cartridge magazine so as to permit the feeding of cartridges serially therefrom during operation of the handgun. The metal frame structure further defines handgrip seat bosses on each side thereof having handgrip seats of a character adapted to receive by means of sliding fit, an integral handgrip structure in such manner as to establish firm, mechanically interlocked relation between the frame and handgrip structures.

The handgrip structure is preferably composed of a polymer material and, though substantially rigid, may have a degree of "controlled flexibility" to permit a cushioned or "soft feel" as the handgun is fired. This soft, cushioned feel may also be attained by providing a "joint" for interconnecting the frame and handgrip structures which permits controlled flexibility at the joint. The soft, cushioned feel which is imparted to the hand of the user during firing, instead of the sharply imparted force that is ordinarily felt, adds to the pleasure of the shooting experience through use of the frame/handgrip assembly of this invention. The handgrip structure further includes an integral trigger guard which is received by the metal frame in such manner that both the trigger guard and the polymer handgrip are mechanically interlocked with the frame structure. In the region of the trigger guard, the handgrip defines a trigger shoe opening which is in registry with an internal trigger track that is defined interiorly of the handgrip. The trigger shoe is movably positioned within the trigger shoe opening and the trigger bow is captured for linear movement within the trigger track by the frame structure. Rearward movement of the trigger is limited by the frame.

The handgrip structure may also define a large dimensioned internal cartridge magazine receptacle which merges with the cartridge magazine receptacle of the metal frame to permit the insertion of large capacity, staggered row cartridge magazines into the frame/handgrip assembly. To permit desirable handgrip feel by most handgun shooters and to permit effective use of the handgun by persons having rather small hands, the handgrip defines an external thickness dimension being substantially the same as that of the Government Model 1911 A1 handgun. This feature obviates the large, "bulky" feel that is a characteristic of all autoloading handguns presently known which are capable of receiving enhanced volume, staggered row cartridge magazines.

The polymer handgrip, which is a structural element of the frame/handgrip assembly, is typically of molded construction which defines external checkering or other surface preparation of how substantially the entire surface area thereof to permit optimum manual gripping of the handgrip portion of the handgun during shooting activities. The external surface preparation of the handgrip, i.e., molded checkering, enhances its structural integrity.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

FIG. 1 is an elevational view of a frame/handgrip assembly constructed in accordance with the present invention.

FIG. 2 is an elevational view of the frame portion of the frame/handgrip assembly of FIG. 1.

FIG. 3 is a rear elevational view of the frame structure of FIG. 2.

FIG. 4 is a front elevational view of the frame structure of FIG. 2.

FIG. 5 is a plan view of the frame structure of FIG. 2.

FIG. 6 is a bottom view of the frame structure of FIGS. 1 and 2.

FIG. 7 is an isometric illustration of the handgrip portion of the frame/handgrip structure of FIG. 1.

FIG. 8 is a rear elevational view of the handgrip structure of FIG. 7.

FIG. 9 is a front elevational view of the handgrip structure of FIG. 7.

FIG. 10 is a bottom view of the handgrip structure of FIG. 7.

FIG. 11 is a plan view of the handgrip structure of FIG. 7.

FIG. 12 is a side elevational view of the handgrip structure of FIG. 7.

FIG. 13 is a sectional view of the handgrip structure, being taken along lines 13—13 of FIG. 10.

FIG. 14 is a fragmentary elevational view of the handgrip portion of a frame/handgrip assembly representing an alternative embodiment of the invention.

Figure 15:
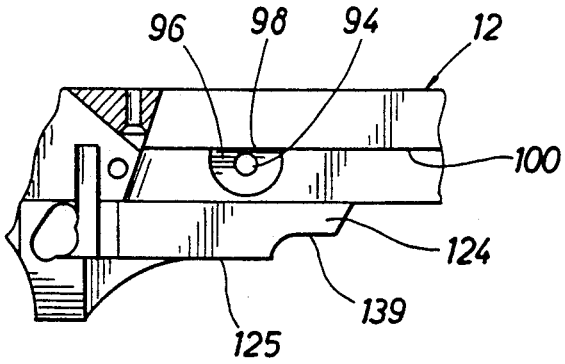

FIG. 15 is a fragmentary sectional view taken along line 15—15 of FIG. 5 and showing a portion of the internal surface configuration of the frame structure of the frame/handgrip assembly.

Figure 16:
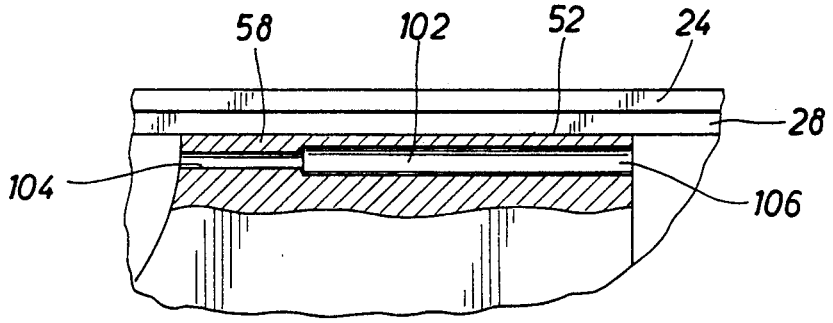

FIG. 16 is a fragmentary elevational view of an intermediate portion of the frame structure of FIGS. 2–6, with a portion thereof cut away and shown in section to depict a spring-detent receptacle thereof in detail.

Figure 17:
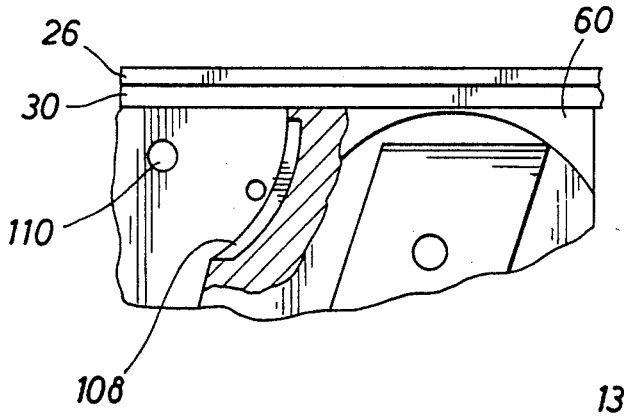

FIG. 17 is a fragmentary elevational view of an intermediate portion of the frame structure with a portion thereof cut away and shown in section to depict an undercut curved slot for receiving the retention tab of an ambidextrous safety.

Figure 18:
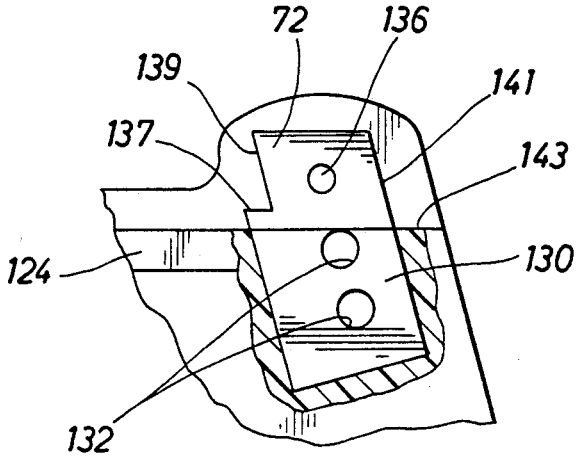

FIG. 18 is a partial sectional view of an upper portion of the handgrip structure representing an alternative embodiment thereof incorporating a molded structural insert.

FIG. 19 is a side elevational view of a staggered row, increased round capacity cartridge magazine to be releasably received within the frame/handgrip assembly of FIGS. 1–18.

FIG. 20 is a rear elevational view of the staggered row, increased round capacity cartridge magazine of FIG. 19.

FIG. 21 is a front elevational view of the cartridge magazine of FIGS. 19 and 20.

FIG. 22 is a top view of the cartridge magazine of FIGS. 19 and 20.

FIG. 23 is a bottom view of the cartridge magazine construction of FIGS. 19–22.

DETAILED DESCRIPTION OF PREFERRED EMBODIMENT

Referring now to the drawings and first to FIGS. 1–6, a frame/grip assembly constructed in accordance with the present invention is illustrated generally at 10 and incorporates an elongate, gripless frame structure shown generally at 12 and a handgrip structure, releasably interconnected with the frame structure and shown generally at 14. The frame structure is preferably composed of a metal material and the handgrip structure is preferably composed of a polymer material but other materials may be employed for the frame and handgrip structures without departing from the spirit and scope of this invention Thus, while metal or polymer may be specifically mentioned, it is not intended to limit this invention to these specific materials.

With respect to FIGS. 1 and 2, it should be born in mind that the metal frame structures shown in these figures are substantially identical with the exception that in FIG. 1 the guide rail portion of the frame is uninterrupted, while the embodiment of FIG. 2 illustrates interrupted guide rails having front and rear pairs of guide rail segments. Otherwise, the structures of the frame embodiments shown in FIGS. 1 and 2 are identical and thus are referred to herein by corresponding reference numerals.

The frame structure 12 is composed of a metal or any other material having the substantial structural integrity of metal or otherwise being suitable for the intended purpose. From the standpoint of metal, a wide range of metals and metal composites may be employed to form the frame structure. Typically, the metal frame 12 is composed of steel and forms upper, forward and rear portions essentially corresponding to the structure of a Government Model 1911 A1 handgun to thereby permit various components of the model 1911 A1, such as the slide, recoil spring assembly, trigger assembly, hammer assembly, etc. to be received in operative relation therewith. The frame structure defines a forwardly extending U-shaped guide trough portion defining a dust cover for the recoil assembly and having flat surface portions 16 and 18 on each side thereof which may be disposed in substantially coplanar relation. The side surface portions are of sufficient structural integrity for support of various sighting devices such as optical sights. While the standard 1911 A1 frame has a thickness dimension of 0.750 inches at the dust cover, the frame of the present invention has a dust cover thickness dimension of 0.830 inches to provide wall structure of greater thickness and structural integrity for drilled and tapped support of optical sighting devices. This particular thickness dimension is not intended to limit the invention, it being within the scope of this invention to employ any desirable thickness dimension for the dust cover. Opposed planar side surfaces 20 and 22 define the opposite side of the frame structure of FIG. 1 and are shown in FIGS. 3 and 4 respectively. The frame structure further defines opposed guide rails 24 and 26 which are defined by respective elongate parallel guide grooves 28 and 30. The guide rails and grooves receive the respective guide flanges of an elongate conventional slide member, not shown. As mentioned above, the slide member may be the conventional slide of a 1911 A1 handgun or a corresponding slide having appropriate guide flanges. It should be born in mind that the present invention is not intended to be limited strictly to the use of a conventional 1911 A1 slide; the guide rails and slide may be of differing dimension as compared to that of the model 1911 A1 handgun in the event such is desired. This character of handgun construction is preferred only because it lends use of the frame/grip assembly of the present invention to utilization of standard 1911 A1 handgun components in operative assembly with the frame/grip assembly of this invention. The frame further defines an elongate recess 32 within in which is received a conventional slide stop having a portion thereof received within a slide stop receptacle 34. Apertures 36 on opposed sides of the frame 12 are provided to receive the transverse pivot pin of the slide stop.

The rear portion of the frame structure 12 is of bifurcated configuration by virtue of a central slot 38 and defines opposed, spaced, rearwardly extending projections 40 and 42 having aligned apertures 44 for receiving a conventional hammer mounting pin. Side surface 16 of the frame defines a specifically configured aperture 46 for receiving a conventional thumb safety lock.

The forward U-shaped guide trough or dust cover portion 18 defines elongate narrow top surfaces 48 and 50 which are seen in FIGS. 2 and 5, and which are disposed in spaced, parallel, coplanar relation. Top surfaces 48 and 50 are positioned a few thousandths of an inch lower as compared to the bottom surface 52 of the respective guide grooves 28 and 30 for the purpose of providing clearance for the retainer flanges of a conventional slide. The U-shaped portion 18 of the frame forms a substantially cylindrical trough portion 54 which receives the recoil spring and spring guide assembly of the conventional 1911 A1 handgun. The forward portion of the frame also defines a bottom recess 56 to provide clearance for the barrel link.

It is desirable to provide means for insuring substantially rigid assembly of the handgrip structure 14 to the frame structure 12. For this purpose the frame 12 defines opposed grip seat bosses 58 and 60 which have a generally rectangular upper portion. The grip seat bosses 58 and 60 each define grip receiving seat depressions or recesses such as shown at 62 which are of a configuration conforming to the upper configuration of the grip structure 14. The handgrip seat recesses 62 are defined in part by a peripheral structural support shoulder 64 which almost entirely encompasses the upper peripheral edges 66–68 of the handgrip structure 14 as shown in FIG. 1 and which provides support in shear for the mating edges of the handgrip. This feature provides a structural interconnection between the frame and handgrip structures so that the handgrip is supported against lateral movement by means of this structural peripheral shoulder interconnection. The handgrip seat bosses 58 and 60 further define one or more keyways such as shown at 68 which define alignment edges 70. The keyways are located within the respective handgrip recesses 62 and receive interlocking keys 72 of corresponding configuration and location as shown in FIGS. 7 and 13 so as to be received in mechanically interlocking relation with respect to the keyway slots 68. The alignment edges 70 of the keyways are preferably oriented to establish a desired handgrip angle, for example 17.5° relative to the guide rails. The keys and keyways may be oriented to establish any suitable directional relationship for keyed assembly of the handgrip and frame constructions Also, if desired, the handgrip may define keyways within which are received keys that are defined by the frame.

Another provision for stabilization of the structural interconnection of the frame and handgrip structures is accomplished in the region of the integral trigger guard portion 76 of the handgrip and its seated relationship with structural components of the frame structure. As shown in FIG. 6 an intermediate portion of the frame structure defines a substantially planar platform 78, having a peripheral edge structure 80 extending about the periphery thereof and defining a lateral support shoulder 82 which is disposed about the planar surface 78. The frame structure further defines a connecting projection 84 forming a connecting pin aperture 85. As shown in FIG. 11 a forwardly projecting platform portion 87 of the handgrip structure 14 defines a substantially planar support surface 88 which is disposed in face-to-face, seated relation with respect to surface 78 of the frame structure when the handgrip is in proper assembly with the frame. In this position the peripheral edge 80 provides support in shear for the periphery of the projecting platform 87.

As shown in FIGS. 11 and 13 the forward portion of the trigger guard support platform structure 87 further defines a depression forming a connecting receptacle 90 within which the connecting projection 84 is received in close fitting relation. When the connecting projection 84 is properly positioned within the receptacle 90, the aperture 85 is positioned in registry with aperture 91 of the trigger guard 76 such that a transverse locking device such as a pin, screw, etc. may be secured to the frame/handgrip assembly to lock the projection 84 in intimate secured relation within the recess 90. This structural interrelation provides lateral stability for the forward frame/handgrip connection as well as supporting the frame against upward or downward rotation relative to the handgrip. As shown in FIG. 15, in the region of the interlocking relationship of the keys 72 with the keyways 68, screws or other connecting elements 92 extend through screw holes 94 in the handgrip 14 and are received by respective threaded openings 94 of bushings 96 which are located internally of the frame structure 12. To provide anti-rotation locking of the bushings with respect to the frame structure the bushings 96 have flats 98 formed thereon which engage a horizontal shoulder anti-rotation 100 formed by an internal step of the metal frame. The bushings 96 are preferably press-fitted into internal apertures of the frame. The bushings 96, in addition to functioning as elements of the handgrip retainer structure, secure the handgrip and frame in immovable assembly. The bushings 96 retain the keys of the handgrip in fully seated relation within the keyways of the frame and thus secure the frame and handgrip in immovable, force transmitting relation, thus enabling the frame and handgrip in immovable, force transmitting relation, thus enabling the frame and handgrip to resist any tendency for separation during shooting activities. The bushings 96 further provide for lateral location of the upper portion of the staggered row magazine which is received within the magazine receptacle of the handgun, this feature will be described in greater detail in relation with the staggered row magazine to be discussed hereinbelow. In the alternative, the handgrip retention bushings may be press fitted into appropriate receptacles defined within the frame structure and may be secured against rotation by any number of suitable means. For example, the bushings may be pinned to the frame structure or may be of non-circular configuration to be received within a corresponding non-circular receptacle. If desired, the bushings may be externally threaded for positive retention within internally threaded bushing receptacles formed in the frame structure.

The handgrip seat boss 58, as shown in greater detail in FIG. 16, defines an internal passage 102 having a small forward bored section 104 and a larger rear bored section 106 to define an elongate internal receptacle for receiving a conventional spring-urged slide stop and thumb safety detent assembly.

As shown in the fragmentary sectional view of FIG. 17, the handgrip seat boss 60 forms a curved, undercut slot 108 which is provided to receive the projecting guide tab portion of a conventional ambidextrous safety having its pivot shaft received by aligned frame openings 110. On the opposite side of the frame structure, a conventional thumb safety is also supported by the same shaft. The undercut slot 108 serves to capture the ambidextrous safety and retain it in movable assembly with the frame structure.

As mentioned above the frame/handgrip assembly of the present invention though adapted to receive standard cartridge magazines with serially oriented cartridges may, if desired, define a rather wide magazine receptacle for receiving large staggered row cartridge magazines therein. According to the present invention a magazine receptacle is defined cooperatively by the frame and handgrip structures. As shown in FIGS. 5 and 6, the frame 12 forms a top opening 114 of generally rectangular configuration having its upper, forward portion in registry with a curved cartridge feed depression or recess 116 which serves to guide cartridges into the cartridge chamber, of the handgun barrel. The generally rectangular opening 114 defines the upper portion of a cartridge magazine receptacle 118. The cartridge magazine receptacle, as shown in the bottom view of FIG. 6, is defined by internal stepped surfaces 120 and 122. The internal surfaces of the magazine receptacle are also defined in part by the inner surfaces of a trigger bow which is slidably received within a trigger track which is cooperatively defined by track section 124 of the frame as shown in FIG. 15 and track section 126 of the handgrip as shown in FIG. 13. In effect therefore, the trigger shoe and trigger bow are wholly contained within the frame/handgrip assembly with upward movement thereof being restrained by the trigger bow guide surface 125 of the frame. As shown in FIG. 13 a groove is shown at 126 which cooperatively defines a portion of the trigger bow track of the handgun assembly. The groove or recess defining trigger track section 126 is in communication with a trigger shoe opening 128 through which the finger engaging trigger shoe portion of the trigger projects for manipulative engagement during firing of the handgun. When the handgrip is assembled to the frame, the trigger bow portion of the trigger will be captured and supported against all but linear movement by the interdependent relationship of the frame and handgrip and with its rearward linear movement being limited by the curved rear portion of the trigger track section 124 of the frame. Consequently, the trigger must be in place when the frame and handgrip are assembled.

As shown in FIGS. 7, 8, 9, 13 and 18 the internal surface configuration of the opposed internal connection portions 75 and 77 of the handgrip structure 14 defines a pair of keys 72 and 74 to be received in interlocking relation within the keyways 68 and 70 of the frame. Although the keys 72 and 74 may be formed integrally with the handgrip structure such as by molding, they are preferably composed of metal or any other suitable structural material defined by an insert 130 which is molded into or otherwise attached to the handgrip structure as shown in FIG. 18. Preferably the insert 130 is composed of a hardened metal and defines a plurality of openings 132 through which moldable material of the handgrip extends in order to establish a positive, interlocked relationship with the material of the handgrip structure. The insert 130 defines an upper opening 136 to receive the locking screw that is threaded through bushing opening 94 and provides for exceptional strength of the structural interconnection between the frame and the handgrip structures.

As shown in FIGS. 15 and 18 the inserts 72 and 74 each form anti-rotation shoulders 137 against which are positioned frame anti-rotation shoulders 139 when the frame and handgrip are properly assembled. These anti-rotation shoulders of the frame and handgrip provide for force transmission in a direction that is transverse to the orientation of the parallel edges 140 and 141 of the keys and substantially parallel to the guide rails 24 and 26. Additionally, the anti-rotation shoulders 137 are located a substantial distance from the point of rotation established by the connecting screws extending through openings 94 and 136 and thus the resulting lever arm about the pivot point provides for significant force resisting capability. Relative adjustment of the frame and handgrip is easily facilitated by the interengaging positioning shoulders 137 and 139. Shoulder 139 may be adjusted by adding or removing metal therefrom. This feature makes the fit of the frame and handgrip "gunsmithable" for alteration of the relative positioning or orientation of frame and handgrip.

The handgrip 14 defines a cartridge magazine receptacle passage 138 which is internally belled at its lower extremity 140 so as to provide for efficient guiding the upper end of a cartridge magazine therein. This is especially an advantage to facilitate rapid magazine reloading. The lower end of the handgrip 14, about the cartridge magazine opening, defines a stop shoulder 142 which encompasses the magazine opening and which is engaged by a positioning surface 144 formed as the upwardly directed surface of a magazine base pad 146 of a staggered row cartridge row magazine 148 which is discussed hereinbelow in relation with FIGS. 18–22.

The handgrip construction 14 comprises a structural element of the frame/handgrip assembly; thus it needs no internal metal handgrip structure as is typically the case with most autoloading handguns. On its curved side surfaces as shown in FIG. 7, the handgrip structure 14 defines diamond shaped checkering 150 which is integral with the material from which the handgrip is composed. This checkering is intended to provide the handgrip with an outer, roughened or textured surface to enable the handgun assembly to be securely gripped by the user even under warm conditions when the user's hands may be perspiring. This checkered surface preparation is also designed to enhance the structural integrity of the handgrip The forward curved surface area 152 of the handgun structure is provided with rather fine checkering which further assists the user's manual gripping of the handgun assembly. The textured surfaces 150–152 will effectively permit the user to efficiently grip the handgun assembly so as to effectively resist any slipping of the handgun relative to the hands of the user during recoil as the handgun is fired. Additionally, the forward blunt surface 154 of the integral trigger guard portion of the handgrip 54 is provided with fine texturing for efficient gripping thereof and is oriented in substantially normal relation with respect t o the planar surface 88. This feature enables efficient two-handed gripping of the handgun assembly to effectively enable stabilization of the handgun during two-handed, rapid fire conditions.

As shown in FIG. 14, representing an alternative embodiment of the handgrip construction, the trigger guard portion of the handgrip construction may define any suitable connection structure, i.e., a dove-tail groove as shown at 155 for support of sighting devices such as laser or infrared sighting devices, global positioning device telemetry devices etc. These features are especially applicable to military or police usage but may have application for civilian usage as well. If desired the handgrip may also define a forwardly extending U-Shaped trough or "dust cover" as shown at 157 in FIG. 14 for establishment of an interfitting relation with a frame structure which does not incorporate a dust cover.

The handgrip structure 14 is preferably composed of a readily moldable material such as any one of a number of suitable polymer materials or any one of a number of suitable metals. From the standpoint of metals, the handgrip may be composed of steel, aluminum, aluminum alloy, titanium, etc. The handgrip is preferably a molded structure for ease of manufacturing although, if desired, it may be machined or manufactured by any other suitable process as well. Especially when composed of polymer material, the handgrip structure of the handgun assembly may be substantially rigid from the standpoint of gripping but may have a controlled flexibility allowing a certain degree of flexure during firing. This feature enables the handgun assembly to have a "soft" or "cushioned" feel rather than the sharp impact that is normally felt when a handgun of this nature is fired. If desired, the keyed connection between the frame and handgrip may be designed to provide a degree of cushioning to promote a "soft feel" during shooting.

As shown particularly in FIGS. 10, 11 and 13, the magazine receptacle portion of the handgrip structure is formed in part by an integral wall structure 156 defining a centrally oriented, vertically opening slot 158. Opposed, generally parallel surfaces 160 and 162 are integral with the handgrip structure and project rearwardly of the wall structure 156. The lower portion of the wall structure defines a transverse structural rib 164 located immediately below a transverse spring locator slot 166. The reinforcement rib 164 is provided in the handgrip structure for receiving and locating a conventional leaf spring of the autoloading handgun assembly. The opposed parallel surfaces 160 and 162, together with the wall or partition 156 cooperatively form an elongate, vertically oriented receptacle or slot which receives a mainspring housing 163. The mainspring housing 163 is pinned by a suitable connector extending through aperture 165 and defines an internal mainspring receptacle 167, the mainspring though wholly contained within the handgrip, is structurally and operationally interdependent upon the hammer assembly which is wholly contained within the frame. This interdependent characteristic is not present in handguns wherein the handgrip section is defined by the frame.

The lower, generally tubular portion of the handgrip structure 14 defines a forwardly projecting arcuate boss 168 having an arcuate, tapered surface 170 which merges with the textured forward surface 152. The boss 168 together with its tapered surface forms an inclined forward projection which, when the handgun assembly is held, forms a tapered, arcuate ledge position for engagement by the lower portion of the little finger of the user. This arcuate, tapered ledge further functions to establish a firm structural interrelation between the hand of the user and the handgrip portion of the frame/-handgrip assembly. The arcuate boss 168 also functions to enhance the structural integrity of the lower portion of the tubular handgrip structure.

Referring now to FIGS. 19–23 the enhanced volume staggered row cartridge magazine 148 defines opposed side surfaces 172 and 174 which are of generally planar configuration and which are disposed in substantially parallel relation. Surfaces 172 and 174 merge smoothly with converging tapered surface portions 176 and 178 respectively.

The tapered upper side surface portions 176 and 178 of the magazine have intermediate, opposed, inclined depressions 180 and 182 which, in conventional manner, form inwardly inclined guide ridges to guide cartridges during upward movement thereof from their staggered row positions so that they emerge at the upper, discharge opening 184 in serially oriented fashion and in location to be transported forwardly into the cartridge chamber of the handgun barrel. The upper rear portion of the cartridge magazine defines a pair of opposed inwardly directed retainer flanges 186 and 188 which define a spacing therebetween of less dimension than the width of the cartridges to be contained in the magazine. The flanges 186 and 188 secure the rear portion of the cartridges against upward movement and release the cartridges only after sufficient forward movement thereof the clear the retainer flanges. A follower member 190 of greater lateral width than the spacing of the retainer flanges 186 and 188 is urged upwardly against the retainer flanges or against cartridges contained in the magazine by means of a coil spring 187. The follower 190 defines an elongate, arcuate cartridge trough 192 which functions to orient the cartridges with respect to the magazine and to serve as a guiding surface for the last of the serially oriented cartridges.

Along its length, the cartridge magazine also defines a substantially planar end surface 194 as shown in FIG. 19 and a more rounded end surface 196 as shown in FIG. 21. These end surfaces are preferably integral with the side surfaces 176 and 178. For cartridge inspection the side surfaces define a plurality of apertures 198 through which cartridges may be inspected to determine by rough estimate the number of cartridges remaining within the magazine at any given time.

The base pad 146 is preferably of molded construction, being molded from any one of a number of polymer materials. The base pad structure forms an internal receptacle 200 within which portions of the side surfaces 172 and 174 are slightly belled outwardly and are received in interlocking relation with internal, lateral slots 202 and 204 to thus retain the base pad in firmly assembled relation with the elongate tubular portion of the magazine.

In the unlikely event that substantial gas pressure might be developed within the magazine, the base pad structure is designed to effect release of the gas prior to the development of any significant gas pressure that could otherwise rupture the magazine and/or the handgrip portion of the handgun. This safety feature is provided by forming a blowout opening in the lower wall 206 of the base pad and locating a blowout plate 208 within the base pad which is held in place by the spring 187 and which defines a weakened wall structure which will be sheared and displaced through the base pad opening in the event excessive pressure is encountered. As shown in the bottom view of FIG. 23, the rupture disc 208 may define an aesthetically pleasing pattern such as the star pattern shown at 210. By providing a rupture disc of this nature, the cartridge magazine will release any excessive gas pressure downwardly to thereby provide protection for the user against injury to the hand or face.

In view of the foregoing, it is clearly seen that this invention accomplishes the provision of a frame/handgrip assembly for autoloading handguns which establishes a unique mechanically interlocked assembly of a gripless frame structure and a handgrip structure. The frame/handgrip assembly provides wholly contained structural elements of the handgrip which are functionally interdependent with structural and operational components located wholly within the frame and vice versa. The frame/handgrip assembly further accomplishes the provision of an enhanced cartridge capacity handgun assembly while minimizing the external thickness of the handgrip portion of the handgun and while minimizing the overall weight of the handgun assembly. Thus there is provided through the present invention an autoloading handgun capability in a handgun having a handgrip dimension and overall weight that closely approximates the dimension and weight of a conventional Model 1911 A1 handgun.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A handgun frame/handgrip assembly for an autoloading handgun comprising:

(a) a frame having side portions defining parallel slide guide rails, said frame defining at least one handgrip seat on one of said side portions thereof defining an alignment edge, said frame further defining a cartridge magazine receptacle;

(b) an integral handgrip being configured for establishing intimate removable interlocked assembly with said frame, said handgrip having side portions and defining a cartridge magazine receptacle in registry with said cartridge magazine receptacle of said frame, said integral handgrip further defining at least one connecting element at a side portion thereof being in connecting engagement with said handgrip seat and having aligning engagement with said alignment edge; and (c) retainer means retaining said frame and integral handgrip in releasable interlocking assembly.

2. The handgun frame/handgrip assembly of claim 1, wherein:

(a) said frame defines a first housing for independently containing structural and operational components;

(b) said handgrip defines a second housing for independently containing other structural and operational components; and (c) said first and second housings positioning said structural and operational components in interdependent relation.

3. The handgun frame/handgrip assembly of claim 1, wherein:

(a) said integral handgrip has a first positioning element; and (b) said frame has a second positioning element for positioning engagement with said first positioning element when said frame and handgrip are in assembly.

4. The handgun frame/handgrip assembly of claim 1, wherein:

said integral handgrip defining external integral roughened handgrip surfaces for enhancing non-slip manual gripping thereof during shooting activities.

5. The handgun frame/handgrip assembly of claim 1, wherein:

said integral handgrip being composed of a substantially rigid polymer and defining external handgrip surfaces having integral checkering on the side and forward areas thereof to provide said handgrip with non-slip characteristics to enhance manual gripping thereof, said integral checkering enhancing the structural integrity of said handgrip.

6. The handgun frame/handgrip assembly of claim 1, wherein:

(a) said integral handgrip defines an integral trigger guard; and (b) connecting means of said frame and said integral handgrip establishing structural interrelation of said integral trigger guard with said frame.

7. The handgun frame/handgrip assembly of claim 1, wherein:

(a) at least one connection element projecting from one of said frame and said integral handgrip; and (b) at least one connection receptacle being defined by the other of said frame and said integral handgrip and receiving said connection projection in intimate, laterally supported interfitting relation therein.

8. The handgun frame/handgrip assembly of claim 1, wherein:

(a) said frame construction defines outwardly facing opposed handgrip seats on each side thereof forming a first key element; and (b) said handgrip construction a second key element establishing intimate keyed relationship with said first key element.

9. The handgun frame/handgrip assembly of claim 1, wherein:

(a) one of said handgrip seat and said integral handgrip defines an inner peripheral restraining shoulder; and (b) the other of said handgrip seat and said integral handgrip having an outer peripheral shoulder for intimate supported engagement by said inner peripheral handgrip restraining shoulder.

10. The handgun frame/handgrip assembly of claim 1, wherein:

(a) said frame defines outwardly projecting seat bosses on each side thereof, said seat bosses each defining a handgrip seat; and (b) one of said seat bosses having an elongate slide stop and thumb safety plunger passage therein.

11. The handgun frame/handgrip assembly of claim 1, wherein:

said integral handgrip defines at least one internal key having an assembly stop shoulder being engaged by said frame to establish proper relative positioning of said frame and integral handgrip.

12. The handgun frame/handgrip assembly of claim 1, wherein:

(a) said frame defines at least one anti-rotation stop; and (b) said key defines at least one anti-rotation structure being disposed in intimate force transmitting engagement with said anti-rotation stop when said frame and integral handgrip are in properly seated assembly.

13. The handgun frame/handgrip assembly of claim 1, wherein:

(a) at least one handgrip seat of said frame defines an outwardly facing keyway on a side portion thereof; and (b) said integral handgrip defines an inwardly facing key on a side portion thereof for tight locking interengagement within said keyway.

14. The handgun frame/handgrip assembly of claim 1, wherein:

(a) said frame defines opposed handgrip supporting bosses at opposed sides thereof defining a handgrip seat and having a peripheral restraining shoulder establishing intimate lateral peripheral restraining engagement with said integral handgrip;

(b) said handgrip supporting bosses each defining a key slot; and (c) said integral handgrip having a pair of structural inserts embedded therein each defining a key for establishing intimate structurally interconnected engagement with respective key slots.

15. The handgun frame/handgrip assembly of claim 1, wherein:

said guide rails are interrupted forming front and rear guide rail segments on each side of said frame.

16. The handgun frame/handgrip assembly of claim 1, wherein:

(a) said frame defines upper and lower elongate parallel groove surfaces forming elongate parallel guide grooves on opposite sides thereof being located immediately below respective ones of said parallel guide rails; and (b) said frame at its forward portion further defining an upwardly opening elongate generally "U" shaped trough having parallel upper edges, said parallel upper edges being disposed in off-set relation with said lower elongate groove surfaces to provide slide clearance for said parallel upper edges.

17. The handgun frame/handgrip assembly of claim 1, wherein:

(a) said integral handgrip defines opposed internal trigger tracks therein; and (b) said frame interfits with said handgrip and defines a closure for said internal trigger tracks.

18. The handgun frame/handgrip assembly of claim 1, wherein:

said handgrip construction further defines a trigger shoe opening disposed on registry with said opposed internal trigger tracks.

19. The hand gun frame/handgrip assembly of claim 1, wherein:

said integral handgrip defines a sight mounting base.

20. The handgun frame/handgrip assembly of claim 1, wherein:

said frame and integral handgrip establish a rigid connecting joint, said integral handgrip being formed of a substantially rigid polymer material having sufficient controlled flexibility to permit very slight relative movement of said frame and handgrip during shooting by virtue of said controlled flexibility of said polymer material so as to cushion force transmission to the hand of the user during shooting and provide the user with a soft shooting feel.

21. The handgun frame/handgrip assembly of claim 1, wherein:

said frame and handgrip, when in assembly, cooperatively define a confined trigger track.

22. The handgun frame/handgrip assembly of claim 21 wherein:

(a) said handgrip defines a first internal trigger track section; and (b) said frame defines a second internal trigger track section, when in assembly with said handgrip, said second trigger track section defining a closure for said confined trigger track.

23. The handgun frame/handgrip assembly of claim 1, wherein:

said integral handgrip defines a trigger shoe opening and further defines an internal trigger track in registry with said trigger shoe opening.

24. The handgun frame/handgrip assembly of claim 23, wherein:

said frame defines a trigger retaining shoulder which, when said frame and integral handgrip are in assembly, defines a downwardly facing closure for said integral trigger track.

25. The handgun frame/handgrip assembly of claim 1, wherein:

(a) said frame and said integral handgrip define registering connection apertures on each side thereof;

(b) connection bushings being located within each of said connection apertures of said frame and define internally threaded openings; and (c) connector screws extending through said connection apertures and being received by said connection bushings for securing said frame and said integral handgrip in releasable assembly.

26. The handgun frame/handgrip assembly of claim 25, wherein:

said connection bushings being non-rotatable relation with said frame.

27. The handgun frame/handgrip assembly of claim 25, including:

(a) a staggered row type cartridge magazine being receivable within said magazine receptacle and defining a dispensing end of less width than the width of said magazine receptacle; and (b) said connection bushings defining lateral guide surfaces for centering said dispensing end of said cartridge magazine relative to said cartridge receptacle and cartridge opening of said frame construction.

28. The handgun frame/handgrip assembly of claim 25, wherein:

(a) said frame defines opposed anti-rotation structure; and (b) said connection bushings establishing nonrotatable engagement with said anti-rotation structure to thus prevent rotation of said connection bushings during threading and unthreading of said connector screws.

29. The handgun frame/handgrip assembly of claim 1, including:

a main spring housing being disposed in removable assembly with said integral handgrip.

30. The handgun frame/handgrip assembly of claim 29, wherein:

(a) said frame being composed of metal and having a key receptacle;

(b) said integral handgrip and said mainspring housing being composed of a substantially rigid moldable polymer material; and (c) at least one structural key insert defining said connecting element and being in molded structural interconnection with said substantially rigid moldable polymer with portions thereof disposed for interlocking engagement within said key receptacle, said key insert being disposed for aligned contact with said alignment edge.

31. The handgun frame/handgrip assembly of claim 30, wherein:

(a) said key receptacle being a key slot being open at one end and establishing the angular relation of said integral handgrip with said frame; and (b) said key element also being of corresponding configuration with said key receptacle and entering said key receptacle from said open end during assembly of said integral handgrip and said frame.

32. A frame/handgrip assembly for autoloading handguns comprising:

(a) an elongate gripless metal frame having elongate parallel slots on each side thereof and defining elongate parallel slide guide rails, said elongate gripless metal frame defining an upwardly directed cartridge opening and defining an internal magazine receptacle being in registry with said cartridge opening and being of sufficient internal width for receiving a wide, staggered row, enhanced volume cartridge magazine, said elongate gripless metal frame further defining a handgrip connection on each side thereof; and (b) a handgrip composed of substantially rigid polymer material and forming a structural element of said frame/handgrip assembly, said handgrip having a frame connection on each side thereof being receivable in releasably connected mating relation with said respective handgrip connection of elongate gripless metal frame and extending in angular relation said elongate gripless metal frame, said handgrip being an integral unitary structure forming a wide internal cartridge magazine receptacle of sufficient internal width for receiving a wide, staggered row, enhanced volume cartridge magazine therein, said handgrip having external gripping surfaces defining external checkering for enhancing the efficiency of manual gripping thereof during shooting activities.

33. The frame/handgrip assembly of claim 32, wherein:

said handgrip has a maximum external width of less than 1.305 inches.

34. The frame/handgrip assembly of claim 32, wherein:

said handgrip has a maximum external width of less than 1.4 inches.

35. The frame/handgrip assembly of claim 32, wherein:

(a) said handgrip defines an integral trigger guard and having embedded therein opposed rigid keys each defining anti-rotation shoulders; and (b) said elongate gripless metal frame defining opposed stop shoulders disposed for engagement with said anti-rotation shoulders and establishing an interlocking anti-rotation connection between said elongate gripless frame and said handgrip; and (c) means establishing an interengaging relation between said trigger guard and said elongate gripless frame.

36. The frame/handgrip assembly of claim 32, wherein:

(a) one of said elongate gripless metal frame and said handgrip having a keyway;

(b) the other of said elongate gripless metal frame and said handgrip having a key disposed in structurally interconnected and aligning assembly within said keyway; and (c) said key and said keyway cooperatively defining said frame connection and said handgrip connection.

37. The frame/handgrip assembly of claim 32, wherein:

(a) said elongate gripless metal frame defining a handgrip seat on each side thereof defining said handgrip connection, each of said handgrip seats defining at least one elongate keyway establishing a direction of linear frame/handgrip assembly; and (b) said handgrip having internal keys on each internal side thereof defining said frame connection and being in interlocking and orienting relation with respective keyways.

38. The frame/handgrip assembly of claim 37, wherein:

said handgrip seats define peripheral edges for intimate engagement with peripheral surfaces of said handgrip, said peripheral edges supporting said peripheral surfaces of said handgrip structure in shear.

39. The frame/handgrip assembly of claim 37, wherein:

said handgrip includes structural inserts embedded therein, said structural inserts forming said internal keys.

40. An increased cartridge capacity autoloading handgun frame/handgrip assembly comprising:

(a) a gripless frame composed of metal and defining opposed parallel slide grooves, said frame further defining handgrip seats having a first key connection on each side thereof and defining a cartridge magazine receptacle and cartridge passage;

(b) an integral handgrip composed of polymer material and having a connection portion defining spaced connection elements at the sides thereof having a second key connection for establishing intimate removable assembly with said key connection of said handgrip seats, said handgrip having an external maximum thickness of less than 1.4 inches and defining a cartridge magazine receptacle in registry with said cartridge magazine receptacle of said frame and being of sufficient internal dimension to receive therein an enhanced volume staggered row cartridge magazine; and (c) means for establishing releasable interlocking assembly of said first and second connection elements of said frame and said handgrip.

41. The increased cartridge capacity autoloading handgun frame/handgrip assembly of claim 40, wherein:

(a) said gripless frame defines a seat on each side thereof having a first key element; and (b) said integral handgrip having a pair of spaced connection portions each having inwardly facing second key elements having keyed assembly with respective ones of said first key elements.

42. The increased cartridge capacity autoloading handgun frame/handgrip assembly of claim 41, wherein:

(a) said first key elements are keyways defined by said frame; and (b) a pair of structural inserts being in embedded assembly with said spaced connection portions of said integral handgrip and defining keys disposed in keyed assembly within respective ones of said keyways.

* * * * *